United States Patent [19]

Daenen

[11] 3,996,692

[45] Dec. 14, 1976

[54] CAR AND BOAT TOY WITH REMOVABLE PARTS

[75] Inventor: Robert H. C. M. Daenen, Aalst, Belgium

[73] Assignee: Dart Industries Inc., Los Angeles, Calif.

[22] Filed: Nov. 6, 1975

[21] Appl. No.: 629,243

[52] U.S. Cl. ..... 46/17; 46/202; 46/93

[51] Int. Cl.[2] ..... A63H 33/08

[58] Field of Search ..... 46/17, 93, 96, 101, 46/106, 202

[56] References Cited

UNITED STATES PATENTS

| | | | |
|---|---|---|---|
| 1,350,417 | 8/1920 | McLaren | 46/17 |
| 2,940,211 | 6/1960 | Kelley | 46/17 |
| 3,310,906 | 3/1967 | Glukes | 46/17 X |
| 3,660,927 | 5/1972 | DeChristopher | 46/17 |
| 3,710,509 | 1/1973 | Spiegel | 46/202 X |

*Primary Examiner*—F. Barry Shay
*Attorney, Agent, or Firm*—Leigh B. Taylor; Paul R. Wylie; Kenneth J. Hovet

[57] ABSTRACT

A versatile toy suitable for use as a rolling or floating vehicle and including body axle and wheel parts that are capable of being interrelated one with another in a plurality of ways to create varying embodiments. The unique interrelationships spoken of are, for the most part, capable of creation because similar sized openings and recesses are maintained within the toy body member such that the toy axles therefor conform thereto. Likewise, the wheel constructions include a plurality of similarly sized openings thereby allowing same to be used in a variety of ways in conjunction with the axles and body member.

4 Claims, 11 Drawing Figures

FIG.5
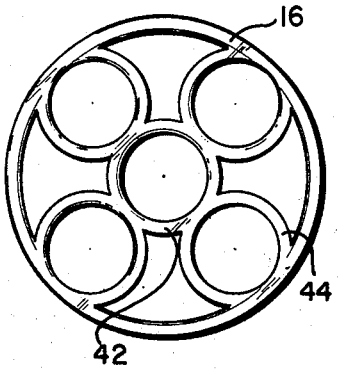
FIG.6
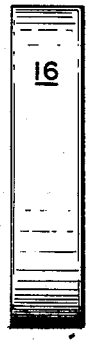
FIG.7
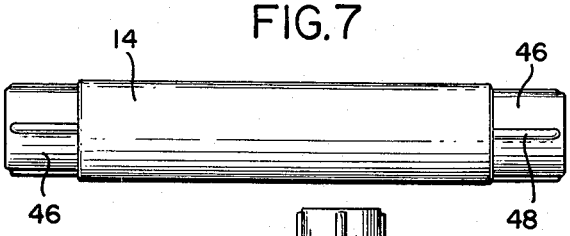
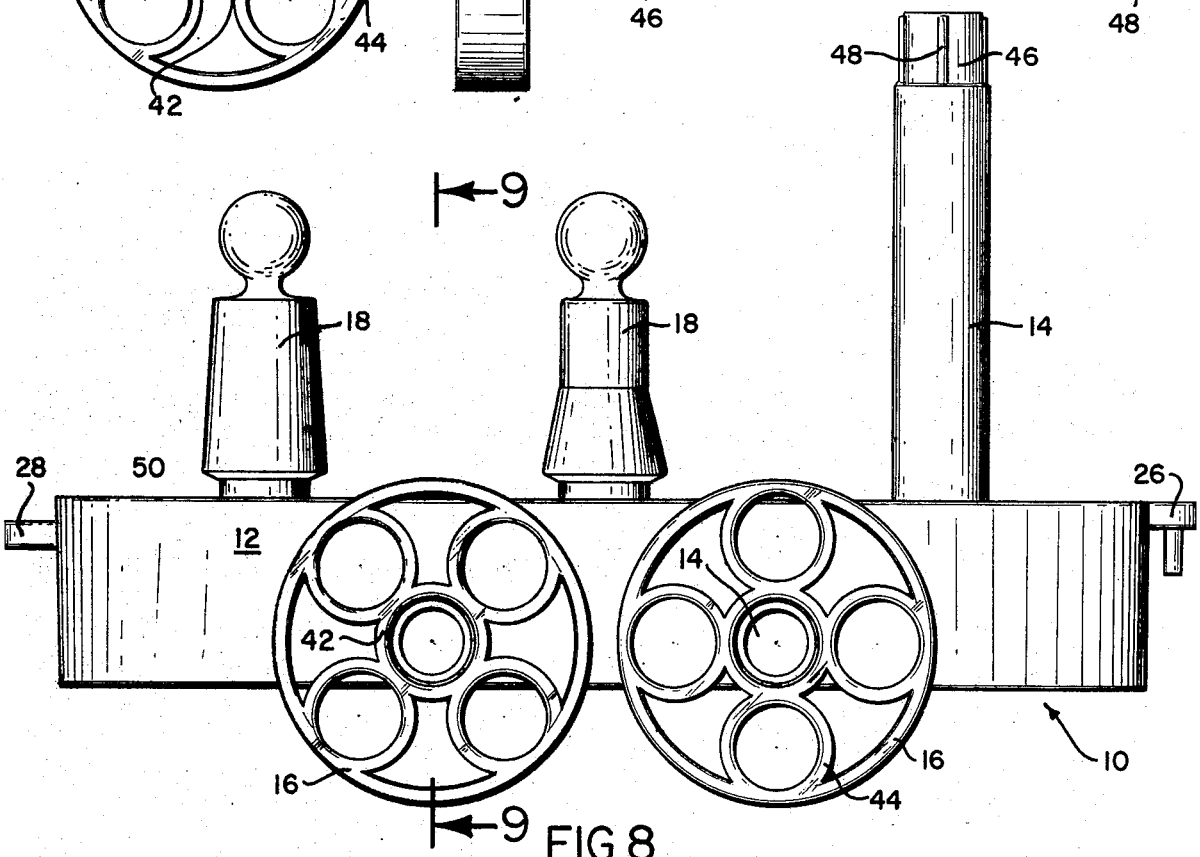
FIG.8
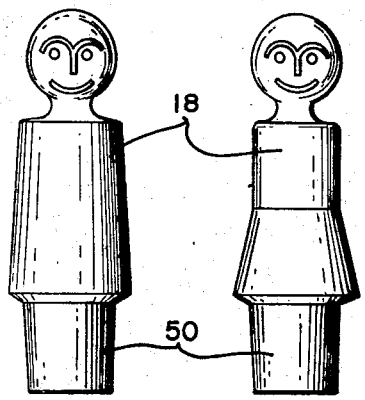
FIG.10 FIG.11
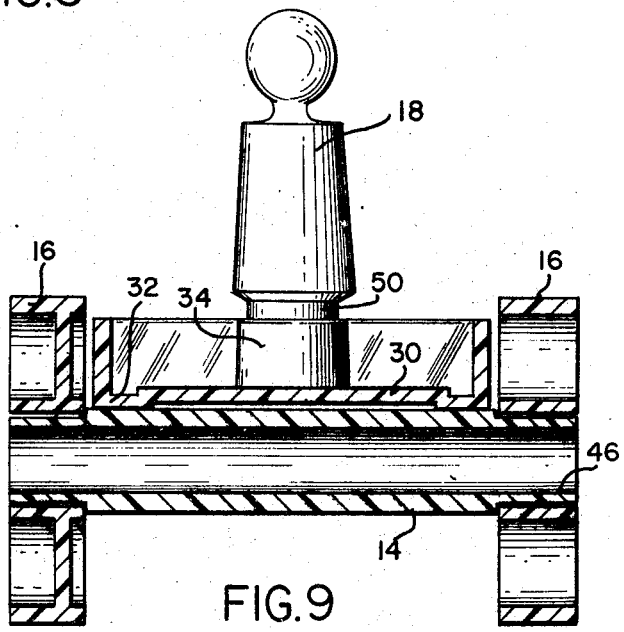
FIG.9

CAR AND BOAT TOY WITH REMOVABLE PARTS

This invention relates to a toy vehicle and, more particularly, to a rolling or floating device whose four piece construction is adapted for assembly in a variety of relationships. Accordingly, any one of a number of different vehicle characterizations may be generated by changing the relationship between the various toy elements. The invention encompasses a basic blocklike body structure that is provided both with projections and recesses that are symetrically located around such member. The configuration of these projections is such that they may receive either elongated axles or toy figurines. The elongated axles may, therefore, be used in just such a sense, that is as extensions through the body member with wheels being positioned on the terminal ends thereof. Or such may be employed in a mast-like form depending upon the character of the vehicle that one intends to create. Furthermore, the vehicle wheels have been uniquely designed providing a plurality of openings in each which will enable the user to position same upon the axle members in any one of a variety of positions. Likewise, each body member is provided with a latch-type means which enables such to be interconnected one with the other thereby producing a toy vehicle train.

Numerous other similar prior art toys are adapted for rolling or floating use by children. However, such toys, for the most part, are not readily capable of assembly in distinctive forms that can vary according to the child's whim or desire. Furthermore, such existing toys do not contemplate the optional use thereof as either a floating or rolling device thereby further increasing the versatility of the toy according to the child's imagination.

Accordingly, it has been a primary objective to provide a toy body construction and associated wheel and axle parts that might be interrelated one with the other in a variety of unique ways to create toy structures of various forms. A further objective has been to similarly create these element parts that, in addition to a vehicle type construction, such may be used to produce art form structures.

These and other objects and advantages of this invention will become more apparent from the following detailed description and drawings wherein:

FIG. 5 is a side elevation of the vehicle wheel;

FIG. 6 is an end view of the vehicle wheel;

FIG. 7 is a side elevational view of the vehicle axle;

FIG. 8 is a side elevational view of the toy vehicle showing one form of assembly suitable therefor;

FIG. 9 is a cross sectional view of the toy vehicle taken along line 9—9 of FIG. 8;

FIG. 10 is a front elevational view of a toy figurine suitable for use within the toy vehicle; and FIG. 11 is another embodiment of a toy figurine similar to that shown in FIG. 10.

Figure 1:
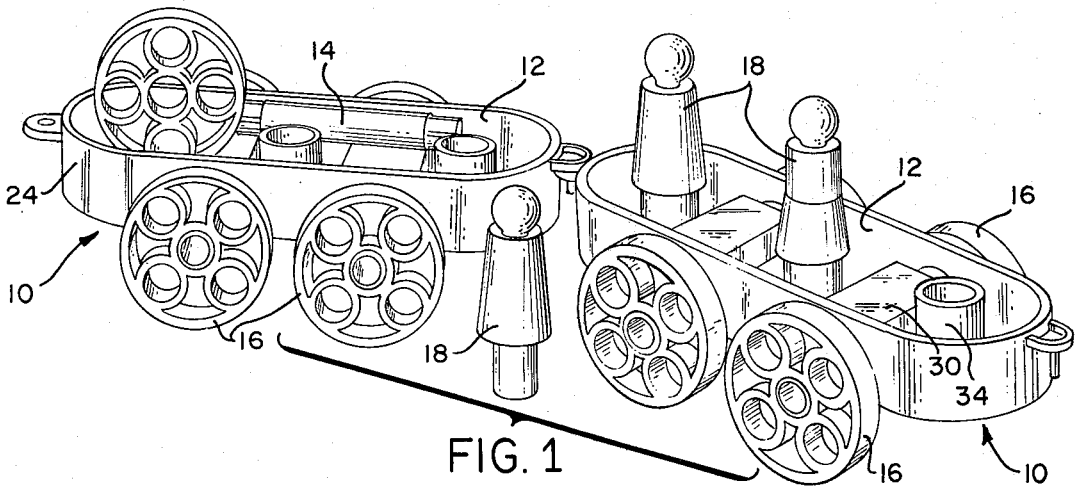
FIG. 1 is a top perspective view of two of the toy vehicles interconnected in trainlike fashion and illustrating the various components that form a part thereof.

FIG. 1 is illustrative of how the toy vehicle 10 encompassed by this invention may be utilized with similar such vehicles in a train-like arrangement that is designed for rolling play. A single such vehicle is further illustrated in an elevation view of FIG. 8 and in both instances, all of the components which interrelate to make such toy are disclosed. These components include a vehicle body member 12, axles 14, wheel members 16 and figurines 18. Using these four elements, one may produce any of a number of different variations in structure such that the toy vehicle is suitable for rolling use as is illustrated in FIGS. 1 and 8, or for floating use (where the axles and wheels are removed), or as an architectural arrangement (not shown). Furthermore, as is illustrated, the toy vehicles 10 may be interconnected as is shown in FIG. 1 or may alternatively be used alone as is illustrated in FIG. 8. Accordingly, either a rolling or floating train may be created.

Figure 2:
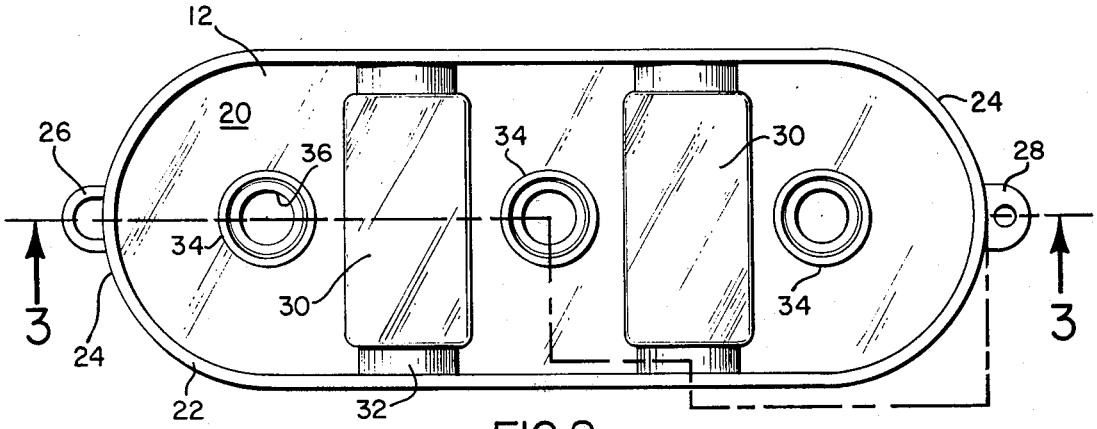
FIG. 2 is a top plan view of the toy vehicle body.
Figure 3:
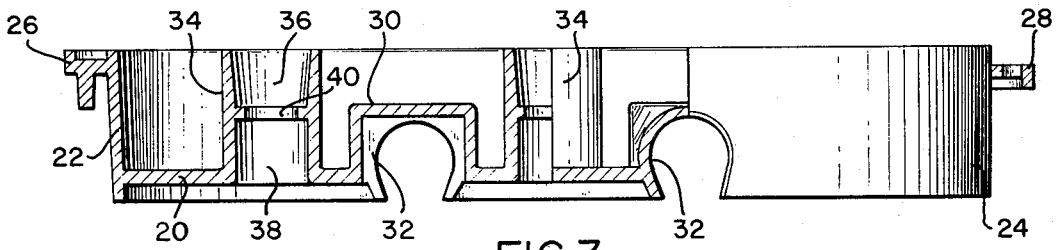
FIG. 3 is a partially sectioned side elevational view of the toy vehicle body such section being taken along line 3—3 of FIG. 2.
Figure 4:
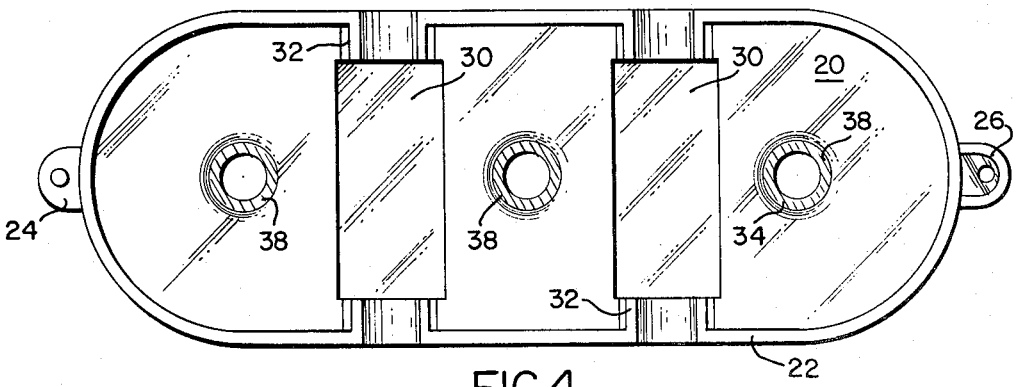
FIG. 4 is a bottom plan view of the toy vehicle body.

As is noted above, the vehicles may be converted from rolling to floating simply by removal of the axles and wheels but of equal importance is the fact that such elements may be used in conjunction with the same body members 12 as is hereinbelow described so that alternative vehicles and structures may be generated. To effect this versatility, reference is directed, in particular, to FIGS. 2, 3 and 4 wherein the body member 12 has its unique structure more clearly illustrated.

The body member 12 is of an elongated shape being formed by a bottom wall 20 and a peripherally extending sidewall 22. The ends of such member 12 are preferably curved as at 24 in a generally uniform manner. It should, however, be noted that although such is a preferred configuration, other different and varied shapes might equally well be employed depending upon the design aesthetics sought to be created. The sidewall 22 at opposed ends of the body member along the curved wall sections supports projecting male and female elements 26 and 28 respectively. It is, of course, these elements that mate one with the other to generate the train-like effect between toy vehicles that is illustrated in FIG. 1.

The bottom wall 20 of toy vehicle 10 includes two laterally extending passageways 30 which terminate at and open through the sidewalls 22 in circular portions 32. These respective passageways and portions are adapted to support the elongated means 14, i.e. axles, in a firm yet removable manner. Accordingly, such axles 14 may simply be slipped through the passageways in a friction fitting relationship with the portions 32. The body member 12 also includes in the preferred form three vertically extending protrusions 34 which emanate from the bottom wall 20 and include opposed recesses 36, 38, which recesses are separated by an annularly extending internal ring 40. These vertically extending protrusions 34 may be used in a variety of different fashions in conjunction with the creation of various toy forms as will be hereinafter described in more detail.

The elongated means 14 (FIG. 7), i.e. axles, are preferably of a circular cross section and include opposite terminal end portions 46 which are of a slightly reduced cross section from that of the central most portion. Furthermore, such terminal end portions 46 have a plurality of axially extending outwardly protruding ribs 48 positioned therearound. Such ribs 48 are adapted to generate the gripping force needed to retain wheel members 16 upon the end portions of the axles. Similarly, such ribs will securely retain the elongated means in any other suitably sized opening.

The wheel members 16 (FIGS. 5 and 6) include in their construction the typical peripherally extending wheel rim inwardly extending supporting webs and the typical wheel hub 42 adapted to accept an axle. This particular construction further includes additional similarly sized hubs and openings 44 that are positioned proximate the wheel rim itself. Accordingly, each of these hubs 42, 44 are adapted to accept the terminal end portions 46 of axle 14. It is, therefore, possible when mounting such wheels upon the toy vehicles to provide for an eccentricity between any of such wheel mountings thereby creating a "strange" rolling action. Likewise, because of this particular construction, the axles and wheels may be individually employed to create tree-like structures or art forms without relationship to the toy vehicle body 12 itself.

The final element which goes into making up the overall toy of this construction is the figurine 18. Such figurine may take any one of a number of various forms such as is illustrated in FIGS. 10 and 11. Of particular importance, however, to this invention is the fact that the base portions 50 of each such figurine are sized so as to mate with either the wheel axle hubs 42, 44 or the recesses 36, 38 in the vertical extending protrusions 34. Accordingly, these figurines 18 or the axle members 14 may be positioned in either of the noted recesses 36 and 38. Axle members 14 so positioned may mount either wheels 16 atop same or may support a second body member 12 in a stacked relationship. In addition, either or both of these members may have positioned therein additional figurines in accordance with the builder's desire. It should further be noted that the axles 14 have reduced end sections 46 which have spaced therearound a plurality of ribs 48. These ribs 48 act as holding element when they are forced into the respective wheel hubs and/or recesses as has been noted above. Accordingly, such will retain the various members in a secured relationship one with the other regardless of how employed.

It should be apparent from the foregoing that the particular features as have been stressed above enable the user to produce or make a plurality of differing toy structures from a minimum of simplistic elements. Such being the case, it is anticipated that the various shapes of the elements described above may vary in certain respects from those disclosed. However, if the size relationships between the axle hubs 46, recesses 36, 38 and wheel hubs 42, 44 are maintained, the aspects of the invention as described will be effectively maintained.

I claim:

1. A toy vehicle suitable for use as either a rolling or floating device and including: a body member having a bottom wall and peripherally extending sidewall which together form a shallow open-topped box-like structure, said bottom wall further including at least two laterally extending passageways produced by upward projections therein, which passageways open through said sidewall, and at least one vertically extending protrusion having opposed recesses opening both to top and bottom of said body; elongated means firmly, but removably, positioned with said passageways and extending therebeyond, said means having terminal end portions of a size corresponding to said recesses; and wheel members having centrally positioned first openings engaged with said terminal end portions.

2. A toy vehicle according to claim 1 wherein said body member includes, at one end thereof, a male element and at the end opposite a female element.

3. A toy vehicle according to claim 1 wherein at least portions of said passageways and said elongated means are of circular cross-section.

4. A toy vehicle according to claim 1 wherein said wheel members also include additional openings of like size to said first openings in juxtaposition with the wheel periphery.

* * * * *